US006954996B2

(12) United States Patent
Borsoi

(10) Patent No.: US 6,954,996 B2
(45) Date of Patent: Oct. 18, 2005

(54) SPORTS BOOT

(75) Inventor: Bruno Borsoi, Victorio Veneto (IT)

(73) Assignee: Salomon S.A., Metz-Tessy (FR)

( * ) Notice: Subject to any disclaimer, the term of this patent is extended or adjusted under 35 U.S.C. 154(b) by 130 days.

(21) Appl. No.: 10/140,938

(22) Filed: May 9, 2002

(65) Prior Publication Data

US 2002/0166260 A1 Nov. 14, 2002

(30) Foreign Application Priority Data

May 10, 2001 (FR) ..... 01 06420

(51) Int. Cl.[7] ..... A43B 5/00; A43B 5/04
(52) U.S. Cl. ..... 36/50.5; 36/117.1
(58) Field of Search ..... 36/50.1, 50.5, 36/117.1

(56) References Cited

U.S. PATENT DOCUMENTS

| | | | | | |
|---|---|---|---|---|---|
| 832,855 | A | * | 10/1906 | Golden | 36/128 |
| 1,745,654 | A | * | 2/1930 | Williams | 36/50.1 |
| 2,041,672 | A | * | 5/1936 | Daniels | 36/50.1 |
| 2,444,428 | A | * | 7/1948 | Carrier | 36/99 |
| 5,271,130 | A | * | 12/1993 | Batra | 24/714.6 |
| 5,377,430 | A | * | 1/1995 | Hatfield et al. | 36/51 |
| 5,566,474 | A | * | 10/1996 | Leick et al. | 36/50.1 |
| 5,906,057 | A | * | 5/1999 | Borsoi | 36/50.1 |
| 5,940,990 | A | * | 8/1999 | Barret | 36/55 |
| 5,966,841 | A | * | 10/1999 | Barret | 36/50.1 |
| 6,264,214 | B1 | | 7/2001 | Bonaventure et al. | 280/11.221 |

FOREIGN PATENT DOCUMENTS

| | | |
|---|---|---|
| DE | 26646 | 4/1884 |
| EP | 0947144 | 10/1999 |
| EP | 1002471 | 5/2000 |
| FR | 2694167 | 2/1994 |
| FR | 2781987 | 2/2000 |

OTHER PUBLICATIONS

U.S. patent application Publication No. 2002/0078597 (BURT), published on Jun. 27, 2002.

* cited by examiner

*Primary Examiner*—M. D. Patterson
(74) *Attorney, Agent, or Firm*—Greenblum & Bernstein, P.L.C.

(57) ABSTRACT

A sports boot including a sole, an upper, at least one flap fixed to the sole or to the upper, the flap covering at least partially a portion of the upper, and at least two keepers and a lace for reversibly tightening the upper, by a relative bringing together or spacing apart the keepers. At least one keeper of the boot is fixed to the flap so as to be located between the flap and the upper.

35 Claims, 3 Drawing Sheets

SPORTS BOOT

CROSS-REFERENCE TO RELATED APPLICATION

This application is based upon French Patent Application No. 01 06420, filed May 10, 2001, the disclosure of which is hereby incorporated by reference thereto, in its entirety and the priority of which is hereby claimed under 35 U.S.C. §119.

BACKGROUND OF THE INVENTION

1. Field of the Invention

The invention relates to the field of sports boots, and more particularly to a boot provided to be removably affixed to a sports apparatus.

These boots are used particularly for snowboarding, skiing, snowshoeing, roller skating, ice skating, mountain climbing, cycling, or the like.

2. Description of Background and Relevant Information

Generally, a boot has a sole, an upper and a reversible means for tightening the upper. The user can thus vary the volume of the boot in order to adapt it to his/her foot.

In the case where the tightening arrangement includes at least two keepers and one lace, the upper is tightened by tensioning the lace. Generally, the keepers and the lace are arranged on the periphery of the upper, on the top of a lower portion and/or at the front of an upper portion of the upper.

To facilitate the tightening of the upper, it has been proposed to fix a flap to the sole or to the upper. According to French Patent Publication No. 2 694 167, the flap covers a portion of the upper, with at least part of the keepers fixed to the flap. During tightening, the flap slides on the upper, thus increasing the forces exerted by the lace. As a result, it is easier to tighten the upper.

It has become apparent that during a sporting activity, the keepers or the lace wear out for reasons unrelated to the tightening forces.

Such is the case, for example, in snowboarding when the user rides a chair lift. In that case, one boot remains attached to the board and the other boot is sometimes slid under the board to reduce stress on the leg that holds the board.

The running edge of the board contacts the boot upper, particularly in the area of the keepers, like a knife. Consequently, incipient fractures and cuts are made on the keepers, laces or the upper, reducing the life of the boot.

In skiing, it is the running edge of the ski that sometimes presses or rubs against the boot that is retained on the other ski.

In snowshoeing or in mountain climbing, the teeth of an ice knife or crampons occasionally press on a boot when walking.

SUMMARY OF THE INVENTION

One of the objects of the invention is to eliminate or substantially reduce the wear on the keepers, laces or boot upper, which results from the action of outside elements.

Another object of the invention is to facilitate the tightening of an upper that is tightened by means of a lace.

To this end, the invention proposes a sports boot having a sole, an upper, at least one flap fixed to the sole or to the upper, with the flap covering at least one portion of the upper, and at least two keepers and a lace for reversibly tightening the upper by a relative bringing together or distancing of the keepers.

At least one keeper according to the boot of the invention is fixed to the flap so as to be located between the flap and the upper.

The flap protects the upper, the keepers covered by the flap, and at least a portion of the lace. In this way, the wear on the boot that results from contacts with external objects and surfaces is reduced. Furthermore, the flap increases the tightening forces of the lace.

BRIEF DESCRIPTION OF DRAWINGS

Other characteristics and advantages of the invention will be better understood from the following description, with reference to the attached drawings showing, by way of non-limiting example, how the invention can be embodied and in which.

DETAILED DESCRIPTION OF THE INVENTION

The embodiment of the invention, described hereinafter with reference to FIGS. 1–3, relates to a snowboard boot, although the invention is applicable to sports boots more generally, as mentioned above.

Figure 1:
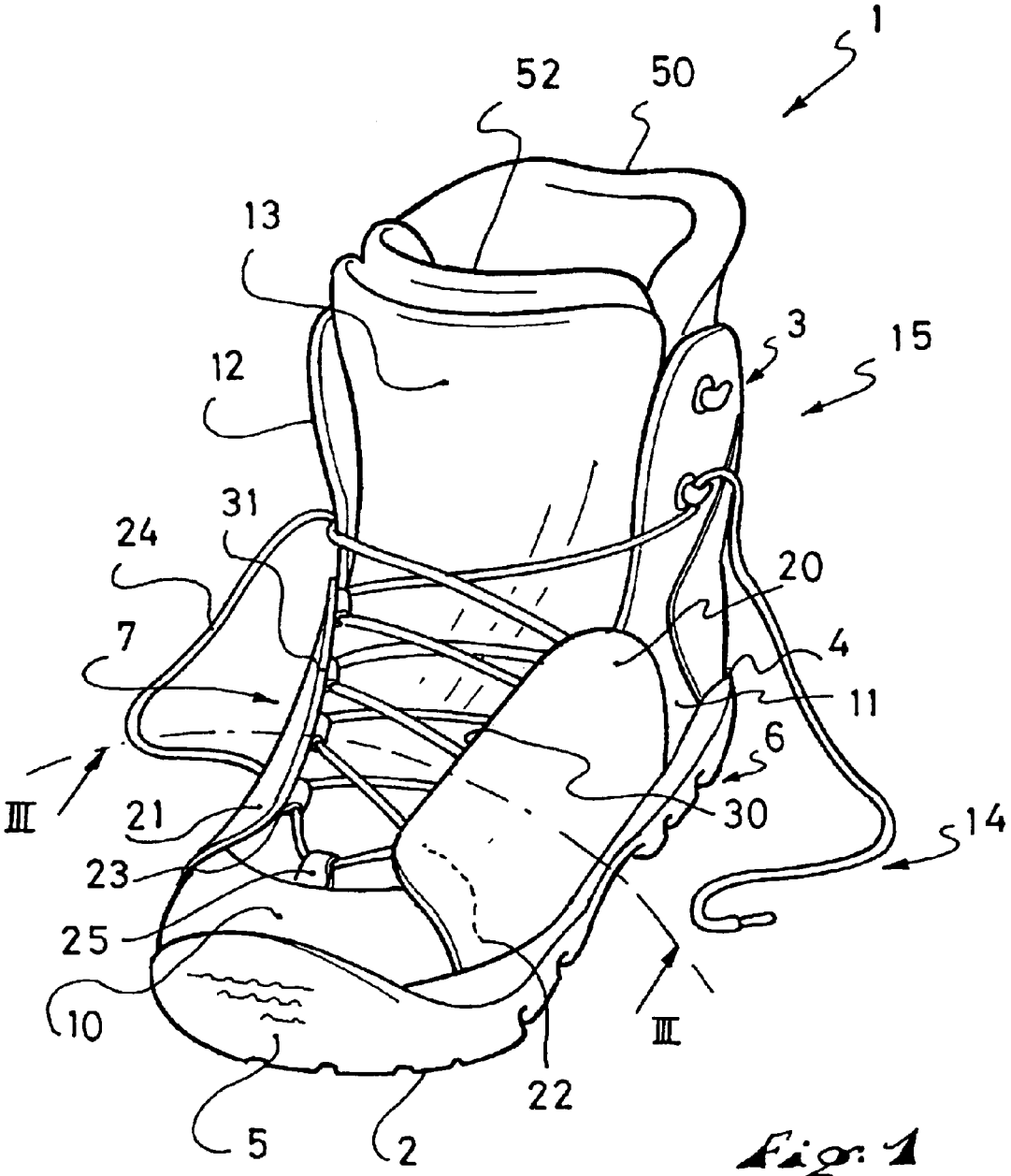
FIG. 1 is a perspective view of a boot, according to the example of embodiment of the invention, with a medial flap and a lateral flap.

In a known manner and as seen in FIG. 1, a boot 1 has a sole 2 and an upper 3.

The boot 1 extends longitudinally between a rear end or heel 4 and a front end or tip 5. It has a medial side 6 opposite a lateral side 7. The medial side 6 is to be understood as being the side along which the big toe is located when the foot is within the boot.

The upper 3 has a vamp 10, located toward the front of the boot 1, as well as a medial quarter 11 and a lateral quarter 12 that extend the vamp rearwardly and connect together in the area of of the heel 4. The vamp 10 and the quarters 11, 12 demarcate an opening for the passage of the foot, the opening being partially closed by a tongue 13. The tongue 13 preferably extends in the area of the top of a lower portion 14 and of the front of an upper portion 15 of the upper 3.

However, it could be provided that the tongue be elsewhere, for example at the rear in a vertical position.

A tightening arrangement allows tightening the upper 3 in a reversible manner, so as to alternatively retain a foot in the boot 1 or allow passage through the opening.

Figure 2:
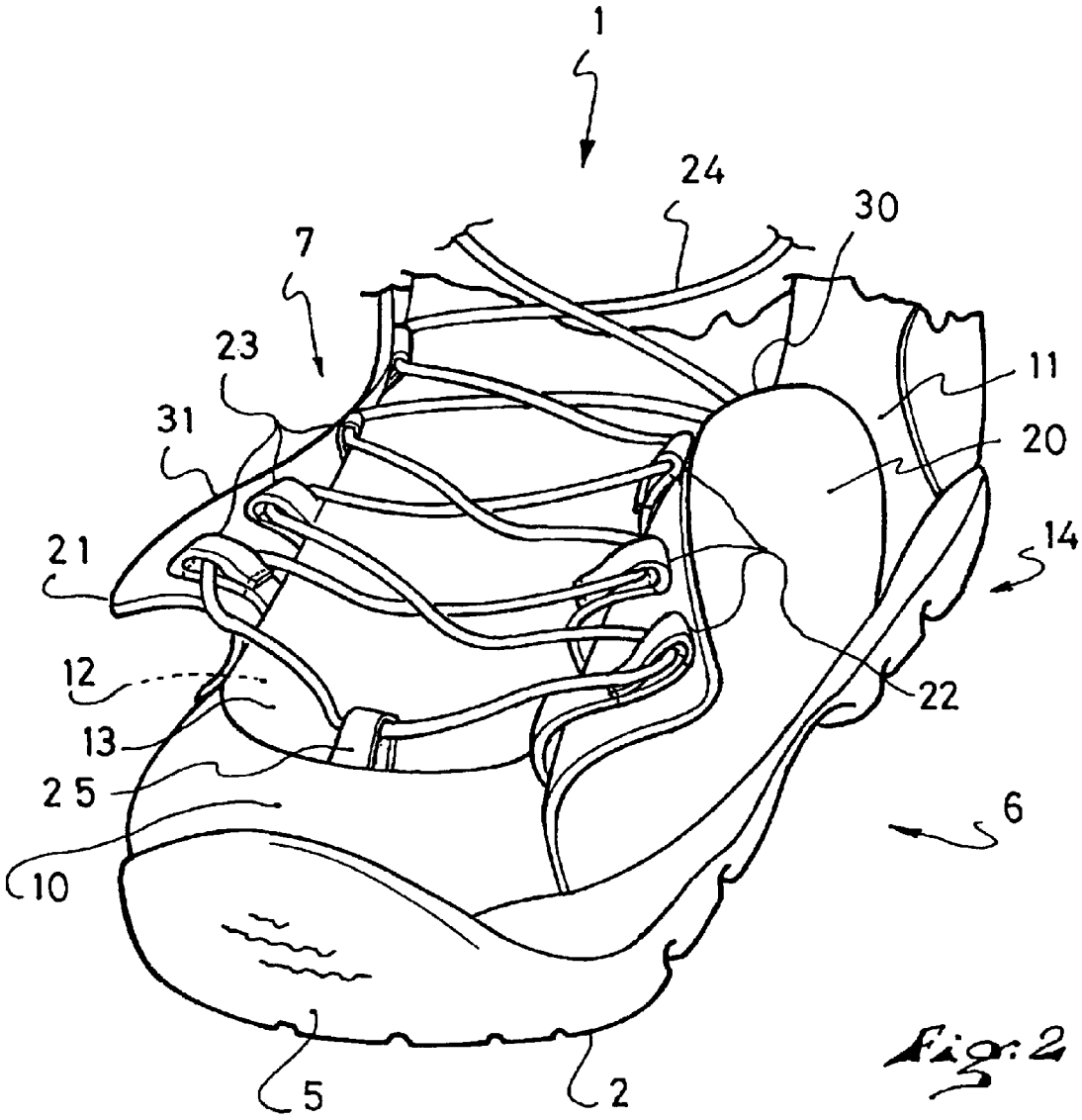
FIG. 2 is a partial view similar to FIG. 1, in a case where the upper ends of the flaps are shown pulled away from the upper to show the keepers of the tightening arrangement.

As seen better in FIG. 2, the tightening arrangement has a medial flap 20, a lateral flap 21, medial keepers 22, lateral keepers 23, and a lace 24. The medial flap 20 and lateral flap 21 respectively cover a portion of the medial quarter 11 and lateral quarter 12, in the area of the lower portion 14 of the upper 3. In the illustrated embodiment of the invention, the upper edges 30, 31 of the medial and lateral quarters 11, 12, respectively, are transversely spaced apart. The medial flap 20 is affixed to the medial quarter 11 in the area of the sole 2. Similarly, the lateral flap 21 is affixed to the lateral quarter 12 in the area of the sole 2. The lace 24 follows a path that passes alternatively through a medial keeper 22 and through a lateral keeper 23. As shown in FIG. 1, between successive keepers, the path of the lace 24 extends transversly from an upper edge of a flap across the vertical median plane of the boot.

A front keeper 25 is provided above the vamp 10, which is a part of the tightening arrangement, to keep the lace 24 from forming too tight a loop in the foremost medial 22 and lateral 23 keepers.

Each keeper is shown in the form of a flexible strap that extends from a lower end up to an upper end, the latter being folded over to form a closed loop. The loop serves as a guide for the lace. The loop is preferably positioned by being stitched onto the strap, but it could be affixed by gluing, welding or any other means. This structure allows the keeper to press on a quarter 11, 12 without creating a stress concentration.

A symmetrical arrangement of four medial keepers and four lateral keepers has been provided, in the area of the lower portion 14 of the upper 3. However, a different number of keepers or an asymmetrical arrangement could be provided.

According to the invention, at least one keeper 22, 23 is fixed to a flap 20, 21 so as to be located between the flap 20, 21 and the upper 3. More specifically, each medial keeper 22 is housed between the medial quarter 11 and the medial flap 20, and each lateral keeper 23 is housed between the lateral quarter 12 and the lateral flap 21.

Figure 3:
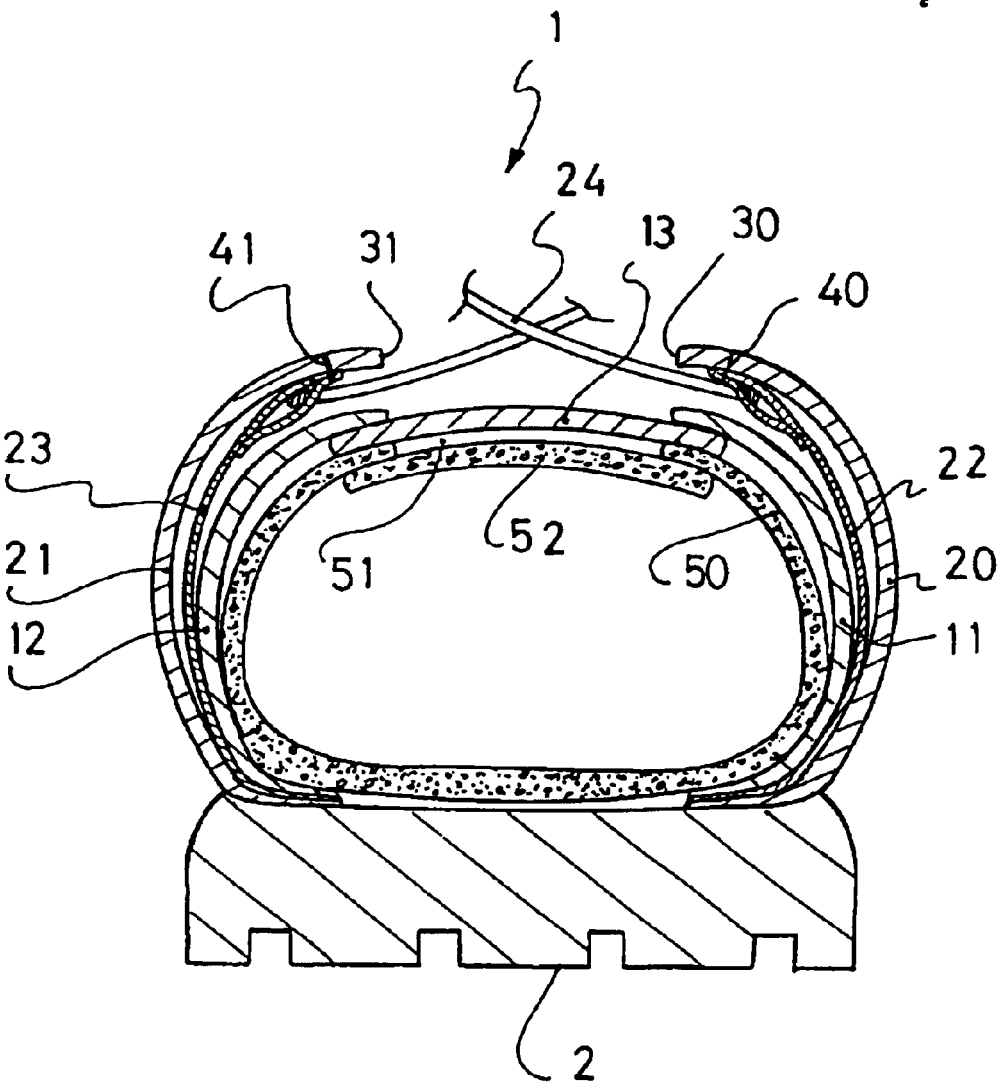
FIG. 3 is a cross-section taken along the line III-III of FIG. 1.

FIG. 3 better shows how a keeper is fixed to a flap.

For instance, a medial keeper 22 is fixed to the medial flap 20, in the area of the upper end of the strap, by a means shown in the form of stitching 40. The latter holds the loop of the keeper to the medial flap 20, near an upper edge 30 of the flap, while the lower end of the strap of the keeper 22 is fixed to the flap 20 by means of an adhesive.

Similarly, a lateral keeper 23 is fixed to the lateral flap 21, in the area of the upper end of the strap, by a means shown in the form of stitching 41. The latter retains the loop of the keeper to the lateral flap 21, near an upper edge 31 of the flap. The lower end of the strap of the keeper 23 is fixed to the flap 21 by means of an adhesive.

Alternatively, other means of fixing could be used, such as ultrasonic sealing or the like.

During the tightening of the upper 3, a traction on the two strands at the end of the lace 24 causes a relative bringing together of the medial 22 and lateral 23 keepers. A relative bringing together of the upper edge 30 of the medial flap 20 and the upper edge 31 of the lateral flap 21 occurs at the same time. The bringing together of the upper edges 30, 31 translates into by a sliding of each identical flap 20, 21 over a quarter 11, 12. This sliding allows better efficiency and reduces the forces to be exerted for an identical tightening of the upper 3.

The keepers 22, 23 also slide over the quarters 11, 12 during tightening. At the end of the tightening, the loops of the keepers 22, 23 are located substantially over the top of the lower portion 14 of the upper 3. Regardless of the state of tension of the lace 24, the flaps 20, 21 cover the medial 22 and lateral 23 keepers, as well as the portions of the lace located in the area of the keepers.

The flaps 20, 21 protect the keepers 22, 23 as well as the lace 24 and portions of the quarters 11, 12 against outside aggressions. As a result, the lifespan of the boot is increased.

In general, the boot according to the invention is made from any known materials and according to any of the techniques known to one skilled in the art.

In particular, as seen in FIG. 3, the flaps 20, 21, the lower ends of the medial 22 and lateral 23 keepers and the medial 11 and lateral 12 quarters are each fixed between the upper and the sole 2 by a means shown in the form of a glue. Other means could nonetheless be used, such as stitching, for instance.

Furthermore, depending on the tightening effect desired, or for stresses related to the thickness of the tightening zone, the flaps 20, 21 can also be fixed to the upper, above the zone for gluing the upper 2, for example, by a stitch. The means for fixing the flaps 20, 21 can also be asymmetrical, i.e., one of the flaps is fixed to the upper, the other to the sole.

In a complementary but optional manner, a liner 50 is provided inside of the envelope of the upper 3. The liner 50 has an opening 51 closed by a tongue 52.

It is to be understood that the invention is not limited to the aforementioned example, and includes all technical equivalents that are encompassed within the scope of the following claims.

Specifically, a different number of keepers and flaps can be provided, and their respective location can be elsewhere. An insert made of plastic, for example, can be provided in the loop of one or several keepers. The insert reduces the rubbing between the lace and the keeper.

What is claimed is:

1. A sports boot comprising:

a sole;

an upper;

tightening arrangement for tightening a foot of a wearer of the boot, said tightening arrangement comprising:

at least one flap fixed to a lateral side or a medial side of the sole or to a lateral side or a medial side of the upper, the flap covering only a portion of the lateral side of the upper or only a portion of the medial side of the upper;

at least two keepers and a lace for reversibly tightening the upper, by a relative bringing together or spacing apart of the keepers, the at least two keepers comprising a lateral keeper and a medial keeper, the lace following a path passing alternately through the lateral keeper and through the medial keeper;

at least one keeper being fixed to the flap so as to be located between the flap and the upper;

an upper edge of the flap translating by a sliding over a quarter of the boot during the reversible tightening of the upper of the boot.

2. A sports boot according to claim 1, wherein said at least one flap comprises a medial flap and a lateral flap, each said flap respectively covering a portion of a medial quarter and a portion of a lateral quarter, in an area of a lower portion of the upper.

3. A sports boot according to claim 2, wherein the medial flap and the lateral flap are each fixed to the boot in an area of the sole.

4. A sports boot according to claim 2, wherein at least one of the medial and lateral flaps is fixed to the upper.

5. A sports boot according to claim 1, further comprising a vamp and a front keeper located above the vamp.

6. A sports boot according to claim 1, wherein a cross-sectional transverse plane extends through the flap, through said at least one keeper, through the upper, and through the sole and, in said cross-sectional plane, the flap extends downwardly at least to a lower portion of the upper.

7. A sports boot according to claim 6, wherein in said cross-sectional plane the flap extends downwardly to a lower portion of the said upper.

8. A sports boot according to claim 1, wherein the path of the lace extends, between successive keepers, transversely from the upper edge of the flap across a vertical median plane of the boot to one of the lateral and medial keepers.

9. A sports boot according to claim 1, wherein the at least one flap is a medial flap, and the upper edge of the medial flap extends in a direction of a length of the boot above the medial side of the upper with the foot of the wearer tightened within the boot.

10. A sports boot according to claim 1, wherein the at least one flap is a lateral flap, and the upper edge of the medial flap extends in a direction of a length of the boot above the lateral side of the upper with the foot of the wearer tightened within the boot.

11. A sports boot according to claim 1, wherein the at least one flap comprises a medial flap and a lateral flap, said medial and lateral flaps being transversely spaced apart.

12. A sports boot according to claim 1, wherein the at least two keepers comprise a plurality of lateral keepers and a plurality of medial keepers, the lace following a path alternately from a first of the plurality of medial keepers to a first of the plurality of lateral keepers, from the first of the lateral keepers to a second the medial keepers.

13. A sports boot comprising:

a sole;

an upper;

tightening arrangement for tightening a foot of a wearer of the boot, said tightening arrangement comprising:

at least one flap fixed to the sole or to the upper, the flap covering at least partially a portion of the upper; and at least two keepers and a lace for reversibly tightening the upper, by a relative bringing together or spacing apart of the keepers, at least one keeper being fixed to the flap so as to be located between the flap and the upper, each of the keepers comprising a flexible strap extending from a lower end up to an upper end, the upper end being folded back to form a closed loop.

14. A sports boot according to claim 13, wherein each of the keepers is respectively fixed to the flap, in an area of the upper end of the strap, by a stitching.

15. A sports boot according to claim 13, wherein each of the lower ends of the straps of a keeper is respectively fixed to the flap by glue.

16. A sports boot according to claim 13, wherein an insert is arranged in the loop of one or several of the keepers.

17. A sports boot according to claim 13, wherein the at least two keepers comprise a plurality of lateral keepers and a plurality of medial keepers, the lace following a path alternately between the pluralities of lateral and medial keepers.

18. A sports boot comprising:

a sole;

an upper;

tightening arrangement for tightening a foot of a wearer of the boot, said tightening arrangement comprising:

a medial flap and a lateral flap fixed to the sole or to the upper, said medial and lateral flaps being transversely spaced apart, each of the medial and lateral flaps at least partially covering, in an area of a lower portion of the upper, respective medial and lateral portions of the upper; and at least two keepers and a lace for reversibly tightening the upper, by a relative bringing together or spacing apart of the keepers, at least one keeper being fixed to the flap so as to be located between the flap and the upper.

19. A sports boot according to claim 18, wherein the at least two keepers comprise a plurality of lateral keepers and a plurality of medial keepers, the lace following a path alternately between the pluralities of lateral and medial keepers.

20. A sports boot comprising:

a sole;

an upper;

at least one flap fixed to a lateral side or medial side of the sole or to a lateral side or medial side of the upper, the flap covering only a portion of the lateral side of the upper or only a portion of the medial side of the upper;

at least two keepers and a lace for reversibly tightening the upper, by a relative bringing together or spacing apart of the keepers, the at least two keepers comprising a lateral keeper and a medial keeper, the lace following a path passing alternately through the medial keeper and through the lateral keeper, at least one keeper being fixed to the flap so as to be located between the flap and the upper and to apply a traction force on the flap during tightening of the upper, an upper edge of the flap translating by sliding over a quarter of the boot during the reversible tightening of the upper of the boot.

21. A sports boot according to claim 20, wherein each of said two keepers is formed of a flexible strap folded to form a closed loop.

22. A sports boot according to claim 20, wherein said at least one flap comprises a medial flap and a lateral flap, each said flap respectively covering a portion of a medial quarter and a portion of a lateral quarter, in an area of a lower portion of the upper.

23. A sports boot according to claim 22, wherein said medial and lateral flaps are transversely spaced apart.

24. A sports boot according to claim 20, wherein a cross-sectional transverse plane extends through the flap, through said at least one keeper, through the upper, and through the sole and, in said cross-sectional plane, the flap extends downwardly at least to a lower portion of the upper.

25. A sports boot according to claim 24, wherein in said cross-sectional plane the flap extends downwardly to a lower end of said upper.

26. A sports boot according to claim 20, wherein the path of the lace extends, between successive keepers, transversely from the upper edge of the flap across a vertical median plane of the boot to one of the lateral and medial keepers.

27. A sports boot according to claim 20, wherein the at least two keepers comprise a plurality of lateral keepers and a plurality of medial keepers, the lace following a path alternately from a first of the plurality of medial keepers to a first of the plurality of lateral keepers, from the first of the lateral keepers to a second the medial keepers.

28. A sports boot comprising:

a sole;

an upper;

at least one flap fixed to a lower portion of a medial side or a lateral side the upper and/or to a medial side or a lateral side of the sole, said flap covering at least partially a portion of the upper; and a tightening arrangement to tighten the upper upon a foot of a wearer of the boot, said tightening arrangement comprising a lace and a plurality of keepers, said plurality of keepers comprising at least a lateral keeper and a medial keeper, said lace being guided by said plurality of keepers by following a path passing alternately through the lateral keeper and the medial keeper, said plurality of keepers being attached to an underside of said at least one flap proximate an upper end of said at least one flap, said upper end of said at least one flap translating by sliding over a quarter of the boot during said reversible tightening of said upper of the boot.

29. A sports boot according to claim 28, wherein said at least one flap comprises a medial flap and a lateral flap, each said flap respectively covering a portion of a medial quarter and a portion of a lateral quarter, in an area of a lower portion of the upper.

30. A sports boot according to claim 28, wherein the at least two keepers comprise a plurality of lateral keepers and a plurality of medial keepers, the lace following a path alternately between the pluralities of lateral and medial keepers.

31. A sports boot according to claim 29, wherein said tightening arrangement comprises one and only one lace.

32. A sports boot according to claim 28, wherein said sports boot is a snowboard boot.

33. A sports boot according to claim 28, wherein said plurality of keepers guide said lace completely beneath said at least one flap.

34. A sports boot comprising:

a sole;

an upper;

a medial flap and a lateral flap fixed to a lower portion of a medial side or a lateral side the upper and/or to a medial side or a lateral side of the sole, said medial and lateral flaps being transversely spaced apart, each of said medial and lateral flaps at least partially covering, in an area of a lower portion of said upper, respective medial and lateral portions of said upper; and a tightening arrangement to tighten the upper upon a foot of a wearer of the boot, said tightening arrangement comprising:

a lace and a plurality of keepers;

said lace being guided by said plurality of keepers;

said plurality of keepers comprising:

keepers attached to an underside of said medial flap proximate an upper end of said medial flap; and keepers attached to an underside of said lateral flap proximate an upper end of said lateral flap.

35. A sports boot according to claim 34, wherein the lace follows a path alternately between the keepers attached to the underside of the lateral flap and the keepers attached to the underside of the medial flap.

* * * * *